United States Patent [19]

Price

[11] 4,167,202

[45] Sep. 11, 1979

[54] WIRE TWISTING APPARATUS

[75] Inventor: Thomas L. Price, Melbourne, Fla.

[73] Assignee: Harris Corporation, Cleveland, Ohio

[21] Appl. No.: 818,744

[22] Filed: Jul. 25, 1977

[51] Int. Cl.[2] ..... B21F 7/00

[52] U.S. Cl. ..... 140/115; 140/149; 29/564.4

[58] Field of Search ..... 140/113, 115, 149, 140; 72/64; 226/97; 57/77.42, 106, 77.3, 51.4, 51; 29/564.4

[56] References Cited

U.S. PATENT DOCUMENTS

| | | | |
|---|---|---|---|
| 940,231 | 11/1909 | Blessing | 57/77.42 |
| 2,969,093 | 1/1961 | Jones | 140/140 |
| 3,713,572 | 1/1973 | Goldsworthy et al. | 226/97 |

*Primary Examiner*—Lowell A. Larson
*Attorney, Agent, or Firm*—Craig and Antonelli

[57] ABSTRACT

An apparatus for twisting two or more electrical conductors into a single cable, each of the conductors having a portion of their insulation stripped at each end. Wires of a desired length are cut and stripped and fed through a twist die having a belled entry to a point where the wires are gripped in a nip formed between a pinch roll and a power roll. These rolls are mounted so as to be swung about the longitudinal axis of the wires so as to twist the wires together into a single cable. A manifold and air supply system is provided so as to prevent lateral swinging of the twisted cable as it passes from the rollers to a wire guide from which the completed cable is dropped into a wire tray.

20 Claims, 6 Drawing Figures

WIRE TWISTING APPARATUS

BACKGROUND AND SUMMARY OF THE INVENTION

This invention is directed to wire twisting machines and in particular to apparatus for twisting two or more electrical conductors of discrete length, which have a portion of their insulation stripped at each end, into a single cable.

Two forms of wire twisting apparatus are known in the prior art. One type of apparatus is suitable for forming twisted cables from wires of indefinite length, while the second type of prior art apparatus is designed to twist together individual wires which have portions of the insulation stripped from one or both of the ends. An example of the first type of twisted cable-forming apparatus is shown in U.S. Pat. No. 3,180,372, wherein wire to form the cable is drawn from a plurality of reels secured to and rotatable with a twister head wherein they are twisted to form the cable and from which they pass directly to a dead block take up unit supported on the frame of the apparatus. The take up unit draws the cable through the twister head and forms it into loose coils. This twisting of the wires is achieved by holding the take up unit fixed while rotating the reels and twister head with respect thereto.

The apparatus according to the '372 patent, while suitable for twisting wires into cable of an indefinite length, is unsuitable for use in twisting short pieces of wire of length up to 3 to 4 feet. Accordingly, in circumstances where individual strands of wire of a finite length are to be stripped and twisted a second form of wire twisting apparatus has been utilized. In U.S. Pat. No. 3,750,720 a wire twister is disclosed which is representative of this second type of twisting apparatus. In the apparatus according to this patent the operator has to go through a number of preliminary steps to put the apparatus in condition to receive a set of wires to be twisted together, after which each of the stripped ends has to be secured in place, the apparatus returned to an operating position, the wires twisted, and then the process repeated so as to enable the cable to be removed and the next set of wires inserted. To achieve the twisting of the wires, the first stripped ends of the wires had to be secured in a clamping device consisting of a pair of rotatable jaws and the other ends of the wires secured in fixed clips. After the wires were secured in position, the jaws were caused to rotate with respect to the clip thereby twisting the wires. As will be appreciated, since the twisting of the wires produces a cable that is shorter in length than the wires individually, the jaws are provided with a means to facilitate their axial movement with respect to the clip securing the other ends of the wires. Accordingly, the apparatus provides a very slow output rate due in particular to the number of steps required to be taken by the operator to set up and remove each pair of wires, and the structure of the apparatus as a whole is complex and costly to produce.

Accordingly, it is an object of this invention to provide a relatively simple machine for twisting a plurality of individual strands of wire, the ends of which have been stripped.

Another object of this invention is to provide an improved wire twisting machine which will twist a plurality of strands of varying gauges to produce cables of predetermined length without the need for the operator to do anything more than insert the wires into an opening.

A further object of the invention is to achieve the above-noted objects without the need for utilizing a complex and relatively expensive apparatus.

In accordance with the present invention the above and still further objects are achieved by an apparatus wherein wires of discrete length are fed into an opening in the twist die so as to be gripped in the nipped form between a power roll and a pinch roll, both of which are mounted so as to rotate about the axis of the die opening as well as their own axes, and from which the twisted cable proceeds into an air manifold where it is held in a laterally stable position within a stream of air until the entire wire comes to rest in a wire guide from which the completed cable is dropped into a storage tray.

These and further objects, features and advantages of the present invention will become more obvious from the following description when taken in connection with the accompanying drawings which show, for purposes of illustration only, several embodiments in accordance with the present invention.

DETAILED DESCRIPTION OF THE PREFERRED EMBODIMENTS

Figure 1:
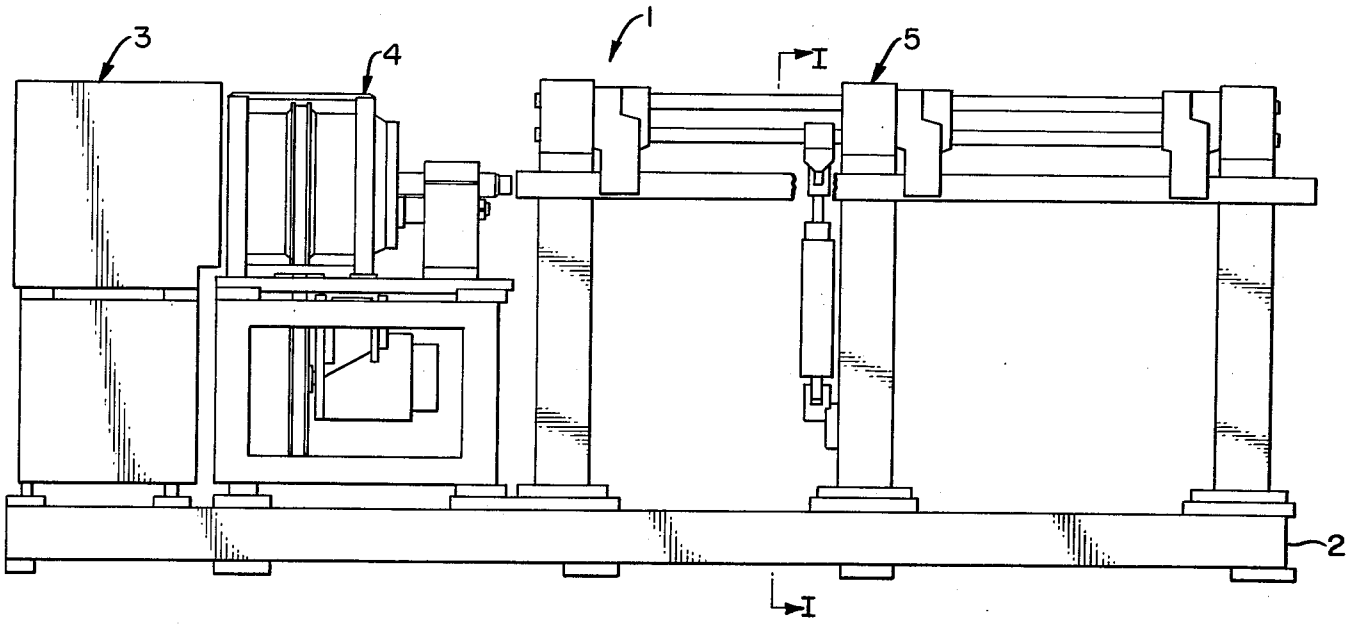
FIG. 1 is a side elevational view of the wire twisting apparatus according to the present invention with a wire cutting and stripping device schematically shown adjacent thereto.

Referring now to the various views of the drawings for a more detailed description of the construction, operation and other features of the invention, in particular, FIG. 1 illustrates the general features and placement of the wire twisting machine 1 on an appropriate supporting deck structure 2 and positioned adjacent a wire cutting and stripping apparatus 3 so as to receive lengths of wire of which the ends have been stripped automatically. It is noted that the wire cutting and stripping device 3 is only generally shown in FIG. 1 and will not be described in detail since the features thereof form no part of the present invention except to the extent that the device is usable therewith, and since reference may be had to U.S. Pat. Nos. 2,811,063; 2,884,825, and 2,934,982, for examples of wire cutter and insulating stripping apparatus suitable for use as the wire cutter and stripper 3. Furthermore, it should be noted that cut and stripped wires need not be supplied directly from an automatic apparatus such as those of the above-referred patents, but rather wires could be cut and stripped manually and fed into the twisting apparatus 1, or wires could be cut and stripped automatically at a separate location by any suitable means and then fed manually into the twisting apparatus 1. Accordingly, the remainder of the detailed description of the present invention will be directed primarily to the construction and operation of the twisting apparatus as opposed to the means by which the wires are cut and stripped and fed to the twisting apparatus.

Figure 2:
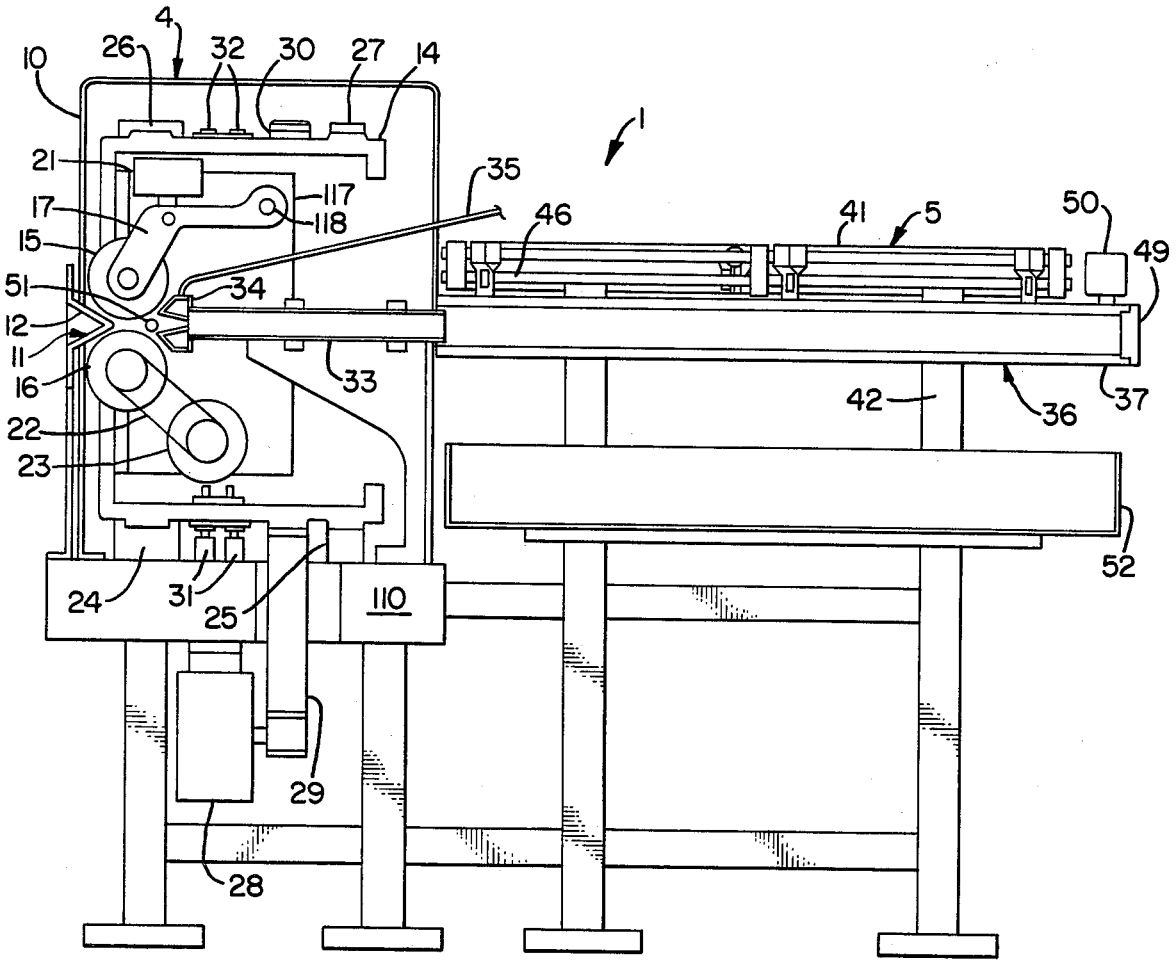
FIG. 2 is a vertical cross-sectional view of the wire twisting apparatus according to the present invention taken along a central longitudinal plane.

Referring now to FIG. 2 of the drawings wherein the twisting apparatus is illustrated by way of a vertical, cross-sectional view, it can be seen that the apparatus 1 is composed generally of two sections, the first being the twisting section generally indicated at 4 and the second being the cable receiving section illustrated generally at 5. The twisting section 4 is shown enclosed by a cover or housing member 10 which has an opening at one side within which is mounted a twisting die 11. The cover 10 is supported upon frame 110 and serves as both a protective cover which acts to keep the operator's hands out of the areas containing movable elements that might cause injury to the operator, and as a shield to deaden the noise of the twisting mechanisms and drives while keeping dust and foreign matter out of the apparatus.

Figure 3:
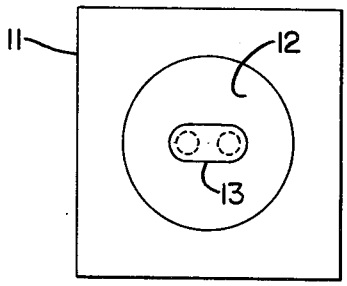
FIG. 3 is a view of the twist die of the present invention with a pair of wires illustrated therein in outline.

The twist die 11 is a stationary member supported by either housing 10 or frame 110 made of either metal or plastic. The die 11 has a belled entry 12 for directing wires toward an ellipticle slot (FIG. 3) which serves a purpose to be described more fully later. As will be appreciated, different dies which have appropriately sized die slots are used dependent on the number and size of wires being twisted together.

Figure 4:
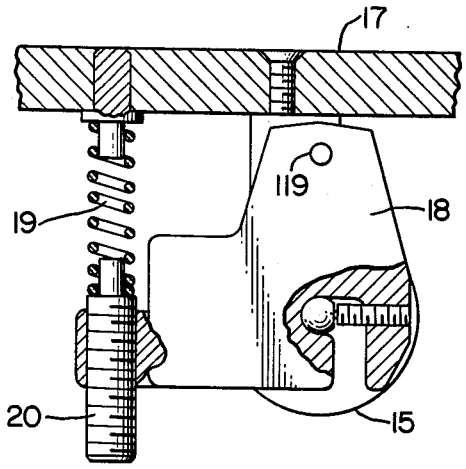
FIG. 4 is a side elevational view illustrating the mounting arrangement for the pinch roll of the present invention.

Mounted within the housing 10 is a generally cylindrical twist head 14 which serves as a housing for carrying power and pinch rolls 15 and 16, respectively. The pinch roll 15 is mounted to a swing arm 17 that is pivotally mounted upon a supporting bracket 17 which is secured to the twist head 14 at a point 118. One suitable means for mounting the pinch roll to the swing arm 17 is illustrated in FIG. 4 wherein the roll 15 is mounted between a pair of brackets 18 which are swingable relative to the arm 17 about a pivot point 119 against the action of a spring 19, the force of which is adjustable by means of a threaded pin member 20 located, for example, in a cross-piece interconnecting the brackets 18, as is illustrated. The swing arm is pivoted in a counterclockwise direction about point 118 so that the roll 15 is brought into contact with a pair of wires under action of a feed solenoid 21, as seen in FIG. 2, so that the wires are pressed between rolls 15 and 16. The power roll 16 is mounted to rotate about an axis which is fixed relative to the twist head 14 so that, under action of the solenoid 21, the wires to be twisted will be pinched between the power roll 16 and the pinch roll 15. A driving force for rotating the power roll 16 is provided by a drive belt 22 which is rotated by a motor 23, both of which are also carried by the twist head 14.

The entire assembly of the twist head and the pinch and power rolls 15 and 16 carried thereby is mounted so as to be rotated about a longitudinal axis of the twisting apparatus. Rotational movement is facilitated by mounting the twist head 14 on forward bearings 24 which provide lateral support for the twist head 14 and upon rear bearings 25 which provide additional radial loading only. A pair of twist caps 26 and 27 hold the twist head in its bearings 24 and 25, respectively, though annular or any other suitable bearing elements may be substituted for bearings 24, 25 and caps 26, 27. Rotational movement of the twist head 14 is provided by a motor 28 driving a gear belt 29 which engages a gear 30 mounted upon the outer surface of the twist head 14. Current can be supplied to the power roll motor 23 and feed solenoid 21 by the utilization of brush holders 31 which ride on the surface of conductive slip rings 32, the slip rings being mounted about the exterior surface of the twist head 14.

Since the end of the twisted cable emerges from the nip between the power roll and pinch roll in an unrestrained manner and rotating under the influence of the twist head 14, provision must be made to prevent the ends of the wires, which have been twisted into a cable, from swinging about laterally, particularly when wires of as much as three and four feet in length are utilized. Accordingly, the present invention prevents this problem from occurring by providing a primary wire guide in the form of a run-out tube 33, which is supported by the frame 110 of the apparatus or the housing 10 by brackets. Run out tube 33 communicates at its inlet end with an air manifold 34 which extends from in close proximity to the pinch and drive rolls 15, 16 to the inlet of the run out tube 33. The air manifold 34 is supplied with a source of pressurized air by way of a tube 35 connected with any suitable source thereof.

Figure 5:
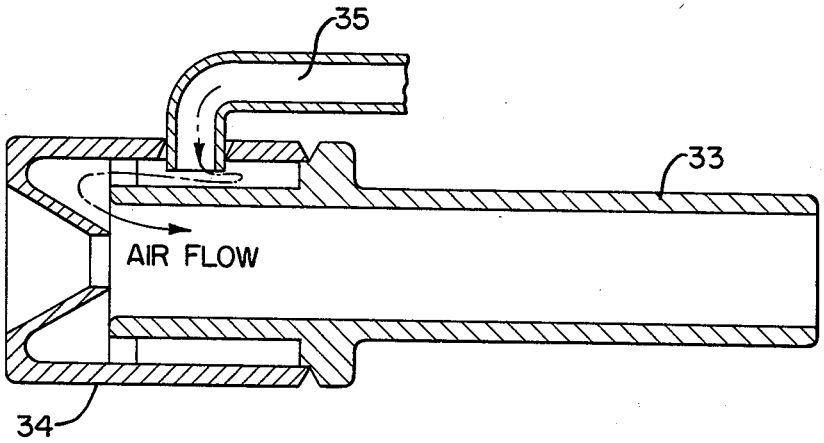
FIG. 5 is a longitudinal cross-sectional view of the primary wire guide and air manifold according to the present invention.
Figure 6:
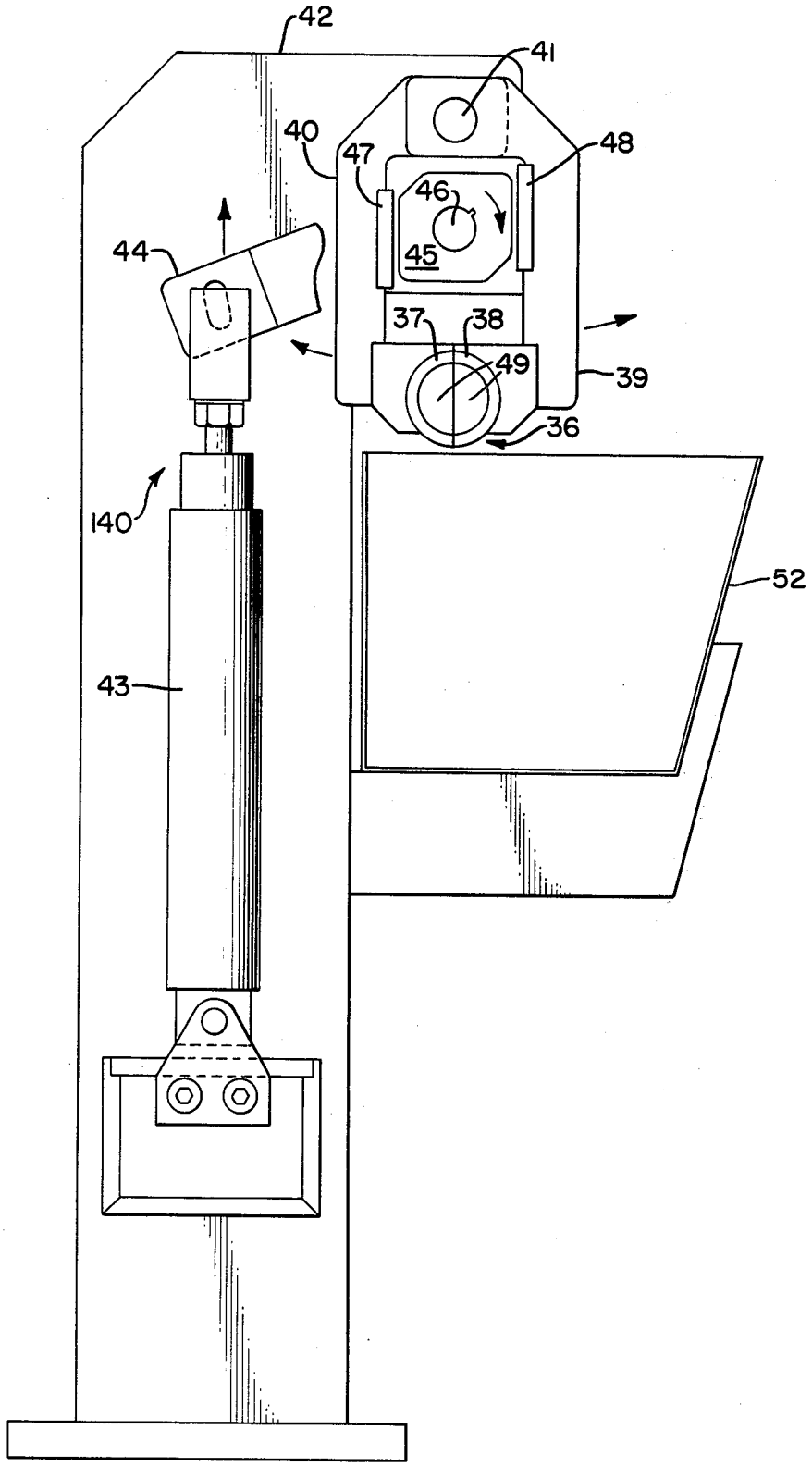
FIG. 6 is a transverse vertical cross-sectional view taken along line I—I of FIG. 1 illustrating the cable releasing actuating mechanism of the wire receiving section of the apparatus according to the present invention.

As is best shown in FIG. 5, air under pressure is supplied through the tube 35 into the manifold 34 where it is caused to be deflected axially along the primary wire guide 33 in a direction from its inlet end to its outlet end, creating an air cushion which supports the wires in a laterally stable position. From the primary wire guide 33 the cable formed from the twisted wires passes into a secondary wire guide 36 which is formed of two semi-cylindrical elements 37, 38. As seen in FIG. 6, the two semi-cylindrical elements 37, 38 are secured to a pair of hinged arms 39, 40 which arms are able to pivot away from each other about a pivot shaft 41 which passes through apertures formed in bracket-like formations of the supporting frame 42. Rotation of the hinged arms is achieved by an actuating means 140 formed by an air cylinder 43 which is connected via a link 44 to a plurality of cams 45 spaced along a cam rod 46. Upon rotation of the cam rod 46, portions of the cam 45 engage against wear plates 47, 48 carried by the respective arms 39, 40, thereby causing the hinged arms 39, 40 to separate in the direction of the arrows as illustrated.

As can be seen in FIG. 2, the end of each of the semi-cylindrical elements 37, 38 located at the downstream end of the secondary wire guide (right hand side of FIG. 2) are provided with end caps 49. The end caps 49 are attached to the downstream or outer end of the secondary wire guide 36 to prevent the twisted cable from being blown out by the supply of air from the manifold 34. Furthermore, the end of the secondary wire guide 36 is provided with a muffler 50 in the area of the end caps 49 so as to reduce the noise of the air escaping from the end thereof.

The operation of the above-described preferred embodiment according to the present invention will now be described. A pair of wires is fed automatically or manually to the twist die 11 and the sloping surface 12 guides the wires into and through the slot 13 to a point at which it is grasped between the power and pinch rolls by actuation of the solenoid 21. At this point, the drive for the twist head 14 and the power roll 16 is actuated such that the wires are drawn inwardly by the power roll 16 while being twisted together by the rotation of the twist head 14 carrying the rolls 15, 16, with the configuration of the slot 13 retaining the entering portions of the wires in a nonrotatable manner. It should be appreciated that by coordinating the relative speeds of the motors 23 and 28, any desired number of twists per inch can be achieved. From the rolls 15, 16 the wires which have been twisted into a cable pass into the manifold 34 and are guided by the sloping surface thereof into the primary wire guide 33 with air from the tube 35 maintaining the cable in a laterally stable position as it passes into the secondary guide 36. When the entire wire has been twisted into a cable and has passed the photo-sensitive cell 51, the power roll drive is deactivated and after a short delay the cylinder 43 is actuated so as to cause the members 37, 38 of the secondary wire guide to be moved apart dropping the completed cable into the wire tray 52. In this manner, the essentially simple apparatus according to the present invention is able to produce twisted cables with a minimum of operator steps in a highly effective and rapid manner.

While the preferred embodiment has been described with respect to twisting together two insulated electrical conductor wires of a prescribed length, those of ordinary skill in the art should recognize that the present invention is also suitable for use in twisting any number of individual wires together, whether insulated or not, and is also suitable for use in twisting together wires of an indefinite length. To twist together more than two wires, the operator need only substitute for the twist die 11 having an elliptical slot 13, a die having a slot configured to receive the desired number of wires, and in certain instances, such as wherein a plurality of wires are desired to be wrapped about a central wire, nonelliptical configurations such as Y, X, etc. may be desirable. Furthermore, if the device according to the present invention is desired for use with wires of a length longer than the machine is designed for, or for twisting cables of indefinite length, the end caps 49 can be removed from the end of the elements 37, 38 and either appropriate extensions attached to the ends of the elements 37, 38, or any other suitable takeup or receiving mechanism placed in position to receive the cables as they emerge from the end of the secondary wire guide.

In addition to the above noted modifications, various other changes and modifications will be apparent to those skilled in the art and, accordingly, the present invention is not intended to be restricted to the preferred embodiments disclosed, but rather should only be viewed as limited by the scope of the appended claims.

I claim:

1. Wire twisting apparatus comprising:

a twist head, die means positioned on one side of said twist head for guiding a plurality of wires into said twist head, and guide means on an opposite side of said twist head for directing multi-strand cables formed by said twist head to a receiving means, wherein said twisted head includes roll means rotatable about axes both parallel and transverse with respect to said wires, and means for rotating said roll means about said axes to both twist said wires and advance them through said twist head, wherein said die means has a surface which conically tapers toward an inlet slot so as to guide said wires thereto.

2. Wire twisting apparatus according to claim 1, wherein said twist head comprises a frame rotatable about an axis parallel to said wires and to which said roll means is mounted, and wherein said roll means includes a drive roll means and a pinch roll means, said pinch roll means being displaceably toward said drive roll means, so as to grip said wires in a nip formed therebetween, and wherein said means for rotating includes motor means for rotating said drive roll about said transverse axis and said frame about said parallel axis.

3. Wire twisting apparatus according to claim 2, wherein solenoid actuated means is provided to displace said pinch roll means toward said drive roll means.

4. Wire twisting apparatus according to claim 1, wherein said guide means includes air means for supporting unsecured portions of said cable as the cable travels from said twist head to said receiving means.

5. Wire twisting apparatus according to claim 1, wherein said receiving means includes a secondary wire guide and a wire receiving tray, and wherein control means is provided to cause a cable to be deposited from said secondary wire guide into said tray, after a predetermined delay, in response to said cable emerging from said nip.

6. Wire twisting apparatus according to claim 5, wherein said secondary wire guide is formed of a pair of semi-cylindrical tube portions and actuating means associated therewith for displacing said tube portions relative to each other.

7. Wire twisting apparatus according to claim 6, wherein said actuating means includes piston-cylinder means for rotating cam means into engagement with parts of supporting means for said tube portions.

8. Wire twisting apparatus according to claim 6, wherein said receiving means includes means for enabling the apparatus to form cables from wires of a length greater than said tube portions.

9. Wire twisting apparatus according to claim 5, wherein said control means comprises photoelectric means for deactivating the roll means and activating the discharge of said cable from said secondary wire guide.

10. Wire twisting apparatus according to claim 1, wherein said twist head comprises an annular frame, bearing means for enabling said frame to be rotatable about an axis parallel to said wires, said roll means being mounted upon said frame, and wherein said roll means includes a drive roll means and a pinch roll means, said pinch roll means being pivotally displaceable toward said drive roll means, so as to grip said wires in a nip formed therebetween, wherein said means for rotating includes first motor means mounted upon said frame for rotating said drive roll about its longitudinal axis and second motor means for rotating said frame about said parallel axis, and wherein power is supplied to said first motor means by contact means mounted to the periphery of frame engaging stationary contact means associated with a source of power.

11. A wire twisting apparatus according to claim 10, wherein said contact means includes a conductive slip ring and said stationary contact comprises a conductive brush holder.

12. Wire twisting apparatus comprising:

a twist head, die means positioned on one side of said twist head for guiding a plurality of wires into said twist head, and guide means on an opposite side of said twist head for directing multistrand cables formed by said twist head to a receiving means, wherein said twisted head includes roll means rotatable about axes both parallel and transverse with respect to said wires, and means for rotating said roll means about said axes to both twist said wires and advance them through said twist head, wherein said twist head comprises a frame rotatable about an axis parallel to said wires and to which said roll means is mounted, and wherein said roll means includes a drive roll means and a pinch roll means, said pinch roll means being displaceably toward said drive roll means, so as to grip said wires in a nip formed therebetween, and wherein said means for rotating includes motor means for rotating said drive roll about said transverse axis and said frame about said parallel axis, wherein insulated wire cutting and end stripping means is positioned adjacent the die means such that wires which have been cut and had their ends stripped will be fed automatically into said die means.

13. Wire twisting apparatus according to claim 12, wherein said die means has a surface which conically tapers toward an inlet slot so as to guide said wires thereto.

14. Wire twisting apparatus according to claim 13, wherein said slot is configured so as to receive a plurality of wires in a manner enabling the wires to pass freely therethrough in an axial direction while being retained in a nonrotatable manner.

15. Wire twisting apparatus comprising:

a twist head, die means positioned on one side of said twist head for guiding a plurality of wires into said twist head, and guide means on an opposite side of said twist head for directing multistrand cables formed by said twist head to a receiving means, wherein said twisted head includes roll means rotatable about axes both parallel and transverse with respect to said wires, and means for rotating said roll means about said axes to both twist said wires and advance them through said twist head, wherein said guide means includes air means for supporting unsecured portions of said cable as the cable travels from said twist head to said receiving means, wherein said receiving means includes a secondary wire guide and a wire receiving tray, and wherein control means is provided to deactivate said air means and, after a predetermined delay, cause a cable to be deposited from said secondary wire guide into said tray in response to said cable emerging from said nip.

16. Wire twisting apparatus according to claim 15, wherein said air means is positioned adjacent said twist head and comprises air manifold means for supplying air from a supply means and a guide tube positioned with respect to said air manifold means so as to enable a flow of air to pass axially along said tube in a direction away from said twist head.

17. Wire twisting apparatus according to claim 15, wherein said control means comprises photoelectric means for deactivating the roll means and activating the discharge of said cable from said secondary wire guide.

18. Wire twisting apparatus according to claim 15, wherein said receiving means includes a secondary wire guide and a wire receiving tray, and wherein control means is provided to cause a cable to be deposited from said secondary wire guide into said tray, after a predetermined delay, in response to said cable emerging from said nip, wherein said secondary wire guide is formed of a pair of semi-cylindrical tube portions and actuating means associated therewith for displacing said tube portions relative to each other, and wherein said tube portions are provided with end caps for preventing twisted cables supplied to said secondary wire guide from being blown out by the air flow from said manifold.

19. Wire twisting apparatus according to claim 18, wherein said tube portions are provided with a sound muffling air outlet.

20. Wire twisting apparatus comprising:

a twist head, die means positioned on one side of said twist head for guiding a plurality of wires into said twist head, and guide means on an opposite side of said twist head for directing multistrand cables formed by said twist head to a receiving means, wherein said twisted head includes roll means rotatable about axes both parallel and transverse with respect to said wires, and means for rotating said roll means about said axes to both twist said wires and advance them through said twist head, wherein said receiving means includes a secondary wire guide and a wire receiving tray, and wherein control means is provided to cause a cable to be deposited from said secondary wire guide into said tray, after a predetermined delay, in response to said cable emerging from said nip, wherein said secondary wire guide is formed of a pair of semi-cylindrical tube portions and actuating means associated therewith for displacing said tube portions relative to each other, wherein said actuating means includes piston-cylinder means for rotating cam means into engagement with parts of supporting means for said tube portions, wherein said receiving means includes means for enabling the apparatus to form cables from wires of a length greater than said tube portions, and wherein said means for enabling includes end cap means detachably mounted to said secondary wire guide.

* * * * *